US008421320B2

(12) United States Patent
Chuang

(10) Patent No.: US 8,421,320 B2
(45) Date of Patent: Apr. 16, 2013

(54) LED LIGHT BULB EQUIPPED WITH LIGHT TRANSPARENT SHELL FASTENING STRUCTURE

(76) Inventor: Sheng-Yi Chuang, Hsinchu (TW)

( * ) Notice: Subject to any disclaimer, the term of this patent is extended or adjusted under 35 U.S.C. 154(b) by 78 days.

(21) Appl. No.: 13/114,804

(22) Filed: May 24, 2011

(65) Prior Publication Data

US 2012/0187818 A1 Jul. 26, 2012

Related U.S. Application Data

(63) Continuation-in-part of application No. 13/012,581, filed on Jan. 24, 2011, now Pat. No. 8,258,683.

(51) Int. Cl.
*F21V 29/00* (2006.01)
*H01J 7/24* (2006.01)

(52) U.S. Cl.
USPC ..... 313/46; 362/373

(58) Field of Classification Search ..... None
See application file for complete search history.

(56) References Cited

U.S. PATENT DOCUMENTS

| | | | | |
|---|---|---|---|---|
| 7,965,023 | B1 * | 6/2011 | Liang | 313/45 |
| 2010/0253200 | A1 * | 10/2010 | Osawa et al. | 313/46 |
| 2011/0101861 | A1 * | 5/2011 | Yoo | 315/35 |
| 2012/0007486 | A1 * | 1/2012 | Mora et al. | 313/46 |

FOREIGN PATENT DOCUMENTS

| | | |
|---|---|---|
| TW | I293807 | 2/2008 |
| TW | M345944 | 12/2008 |
| TW | M358247 | 6/2009 |
| TW | M379021 | 4/2010 |
| TW | 201020457 | 6/2010 |
| TW | 201020465 | 6/2010 |
| TW | M381743 | 6/2010 |

* cited by examiner

*Primary Examiner* — Ashok Patel
(74) *Attorney, Agent, or Firm* — Muncy, Geissler, Olds & Lowe, PLLC

(57) ABSTRACT

An LED light bulb includes a power conversion board, at least one light source baseboard electrically connected to the power conversion board, a heat sink and a light transparent shell to hold the light source baseboard. The heat sink has a wedged groove with a first holding portion formed thereon. The light transparent shell includes a sphere and a neck wedged in the wedged groove. The sphere and neck have an inner wall surrounded to hold the power conversion board and an outer wall opposite to the inner wall. The neck has a longitudinal shell retaining portion on the outer wall corresponding and fastening to the first holding portion and at least one transverse shell retaining portion. The wedged groove has at least one second holding portion corresponding and fastening to the transverse shell retaining portion to restrict relative turning of the light transparent shell and heat sink.

14 Claims, 7 Drawing Sheets

LED LIGHT BULB EQUIPPED WITH LIGHT TRANSPARENT SHELL FASTENING STRUCTURE

This application is a continuation-in-part, and claims priority, of from U.S. patent application Ser. No. 13/012,581 filed on Jan. 24, 2011, entitled "INSULATION REINFORCING LIGHT BULB", the entire contents of which are hereby incorporated by reference.

FIELD OF THE INVENTION

The present invention relates to an LED light bulb equipped with light transparent shell fastening structure and particularly to an improved fastening structure to couple a light transparent shell with a heat sink.

BACKGROUND OF THE INVENTION

Light emitting diode (LED) provides many advantages such as longer lifespan, less power consumption, higher illumination and more eco-friendly materials. With advance of LED fabrication process and lower cost thereof, LED is not only adopted on traffic lights or indication lights of electric appliances, it also can be used on environmental decoration or lighting fixtures. As application scope of the LED lamps has been greatly expanded, they have to pass various official and authorized safety regulation tests before being marketed. Those safety regulation tests include insulation test at higher voltages and aging test at higher temperatures. The insulation test usually is performed at varying positions under a higher voltage to determine whether the insulation structure and internal electronic elements of the light bulb can withstand the high voltage without being pierced. Thus only having excellent insulation capability can pass such insulation test. The aging test is to dispose the light bulb in an environment with a temperature range from 90° C. to −25° C. for dozens of days to withstand temperature variations while torsional force is applied to the light bulb via a machine (such as the torsional force for turning the lamp shell). Such the aging test aims to check whether the coupling among the composed elements of the light bulb is firm enough. The lamp shell generally is bonded to an insulation base or heat sink through adhesive. Although there are various types of the adhesive, those with better heat-resistant capability usually have weaker adhesion force, while those with stronger adhesion force often are deficient in heat-resistance. Thus most adhesive cannot provide both strong adhesion force and great heat-resistant capability. Moreover, it is a severe test for most adhesive to be tested in the environment with temperature variations from 90° C. to −25° C. for dozens of days while the tersional force is constantly applied to.

R.O.C. patent No. M379021 entitled "LED light bulb" discloses an LED light bulb that includes a lamp cap, a lamp shell, an LED driving circuit board held in the lamp shell, a heat dissipation bracket, an LED and a coupling ring located on the heat dissipation bracket and a glass shade. It recites in its specification that " . . . the spherical glass shade has an the annular neck boned to a teeth-shaped flank on the inner rim of the corresponding coupling ring through silicone . . . ". Hence the glass shade in this prior art is bonded to the coupling ring through the silicone.

R.O.C. publication No. 201020465 entitled "Spherical LED lamp and method of manufacturing the same" discloses that a base is wrapped in an inflated foam tape before being inserted into a neck portion of a sphere. After the foam tape is inflated, it can provide anchoring and cooling effect. While this prior art has listed many possible embodiments for materials of the foam, it is not sure whether those materials can pass the severe high temperature test.

Since the glass lamp shade has a smoother edge, it is afraid that using the adhesive to bond the glass lamp shade to the lamp base or heat sink is difficult to pass the high temperature test. However, although using multi-layer or multi-material adhesive to hold the lamp shade might increase the chance to pass the safety regulation tests, the production cost also increases.

SUMMARY OF THE INVENTION

In view of elements in the conventional LED light bulb could easily loosen off or separate due to simple coupling via adhesive during high temperature test in the severe safety regulation tests, the present invention aims to provide a fastening structure for LED light bulbs to substitute the conventional bonding techniques by using adhesive to ensure that the LED light bulbs can be maintained intact for long duration in the high temperature test without aging or separation.

The present invention provides an LED light bulb equipped with light transparent shell fastening structure. The LED light bulb includes a power receiving base, a power conversion board, at least one light source baseboard electrically connected to the power conversion board, a heat sink and a light transparent shell forming a space to hold the light source baseboard. The power conversion board is electrically connected to the power receiving base to provide lighting power to the light source baseboard. The heat sink has a housing chamber to hold the power conversion board and also a wedged groove with a wall formed a first holding portion. The light transparent shell includes a sphere and a neck extended from the sphere to wedge in the wedged groove. The sphere and neck have an inner wall surrounded to form a space to hold the light source baseboard and an outer wall on another side opposite to the inner wall. The neck has a longitudinal shell retaining portion on the outer wall corresponding and fastening to the first holding portion and at least one transverse shell retaining portion. The wedged groove has at least one second holding portion corresponding and fastening to the transverse shell retaining portion to restrict the light transparent shell and heat sink from turning against each other.

Moreover, the LED light bulb further includes a coupling holder in the housing chamber. The coupling holder has a fastening portion at one end fastening to the power receiving base and is divided by an insulation wall to form a circuit holding compartment to hold the power conversion board, and also has a longitudinal holder retaining portion. The heat sink has a third holding portion corresponding and fastening to the longitudinal holder retaining portion to restrict the coupling holder and heat sink from moving vertically against each other. The coupling holder further has at least one transverse holder retaining portion, and the heat sink has at least one fourth holding portion corresponding and fastening to the transverse holder retaining portion to restrict the assembly holder and heat sink from turning against each other.

By means of the construction set forth above, the light transparent shell can be firmly fastened to the heat sink through the longitudinal shell retaining portion and transverse shell retaining portion on the outer wall. As the light transparent shell has the positioning structure formed on the outer wall, it can be made of plastics with a larger curved surface formed. Take a virtual sphere for an example, the curved surface of the light transparent shell can cover at least 75% of the virtual spherical surface, thus a wider light transparent range can be achieved to increase illumination.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1A:
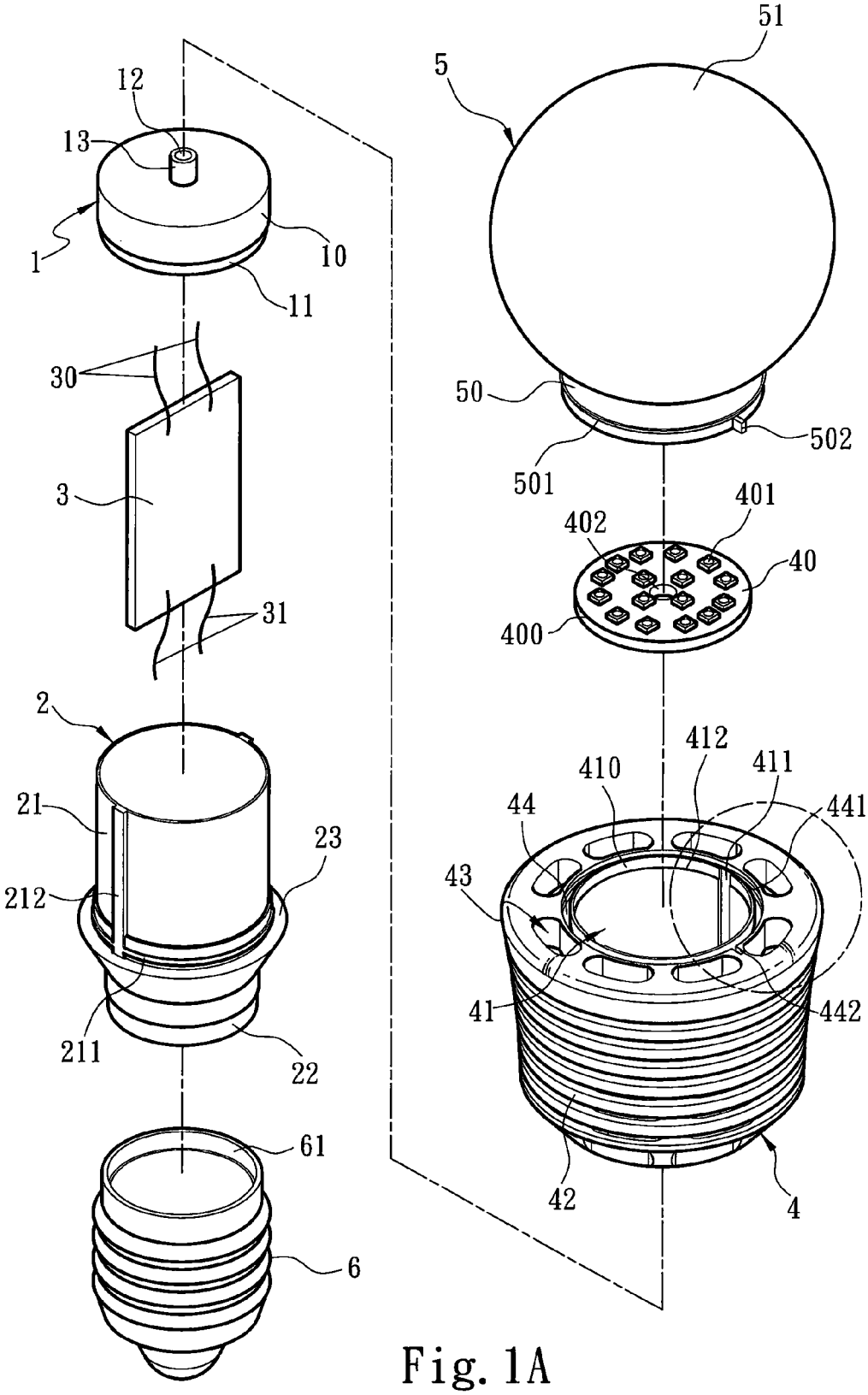
FIG. 1A is an exploded view of the LED light bulb of the invention.

The present invention aims to provide an LED light bulb equipped with light transparent shell fastening structure. Please refer to FIGS. 1A through 4 for a first embodiment of the invention. The LED light bulb in this embodiment includes a light transparent shell 5, a power receiving base 6, a heat sink 4 and a coupling holder 2 located between the light transparent shell 5 and power receiving base 6, at least one light source baseboard 40 located in the light transparent shell 5 and a power conversion board 3 electrically connected to the light source baseboard 40 and power receiving base 6. The power conversion board 3 is preferably a switch-type power circuit. The heat sink 4 has a housing chamber 41 to hold the power conversion board 3. The light source baseboard 40 holds a plurality of LEDs 401 located thereon, and can be an aluminum baseboard containing a plurality of conductive wires. Based on present techniques, the aluminum baseboard can be formed by stacking a copper foil, conductive insulation material and an aluminum sheet over one another. The copper foil is etched to form circuits, and then is wrapped by the conductive insulation material and aluminum sheet to become the light source baseboard 40 with the conductive wires embedded inside. The aluminum baseboard is a technique known in the art and not a key feature of the invention, thus details are omitted herein. In order to provide better positioning effect for the light source baseboard 40, the heat sink 4 has an annular coupling wall 410 to surround and hold the light source baseboard 40. The light source baseboard 40 also has a contact surface 400 on the circumference to tightly in contact with the coupling wall 410 through squeezing the light source baseboard 40 into an area surrounded by the coupling wall 410 so that the light source baseboard 40 can be securely held on the heat sink 4. More specifically, the contact surface 400 is formed at an outer diameter no less than an inner diameter of the coupling wall 410 to allow the light source baseboard 40 to be squeezed onto the coupling wall 410. As the coupling wall 410 is slightly elastic and has desired hardness, the coupling wall 410 can tightly contact with the contact surface 400. The heat sink 4 further has a support portion 412 below the light source baseboard 40 forming a thickness difference with the coupling wall 410 to brace the light source baseboard 40. By means of the light source baseboard 40 tightly coupling with the heat sink 4, better heat conduction effect can be accomplished. Moreover, when the temperature of the light source baseboard 40 rises, the compact coupling of the coupling wall 410 can prevent the light source baseboard 40 from deforming to make sure that cooling effect does not suffer.

Figure 1B:
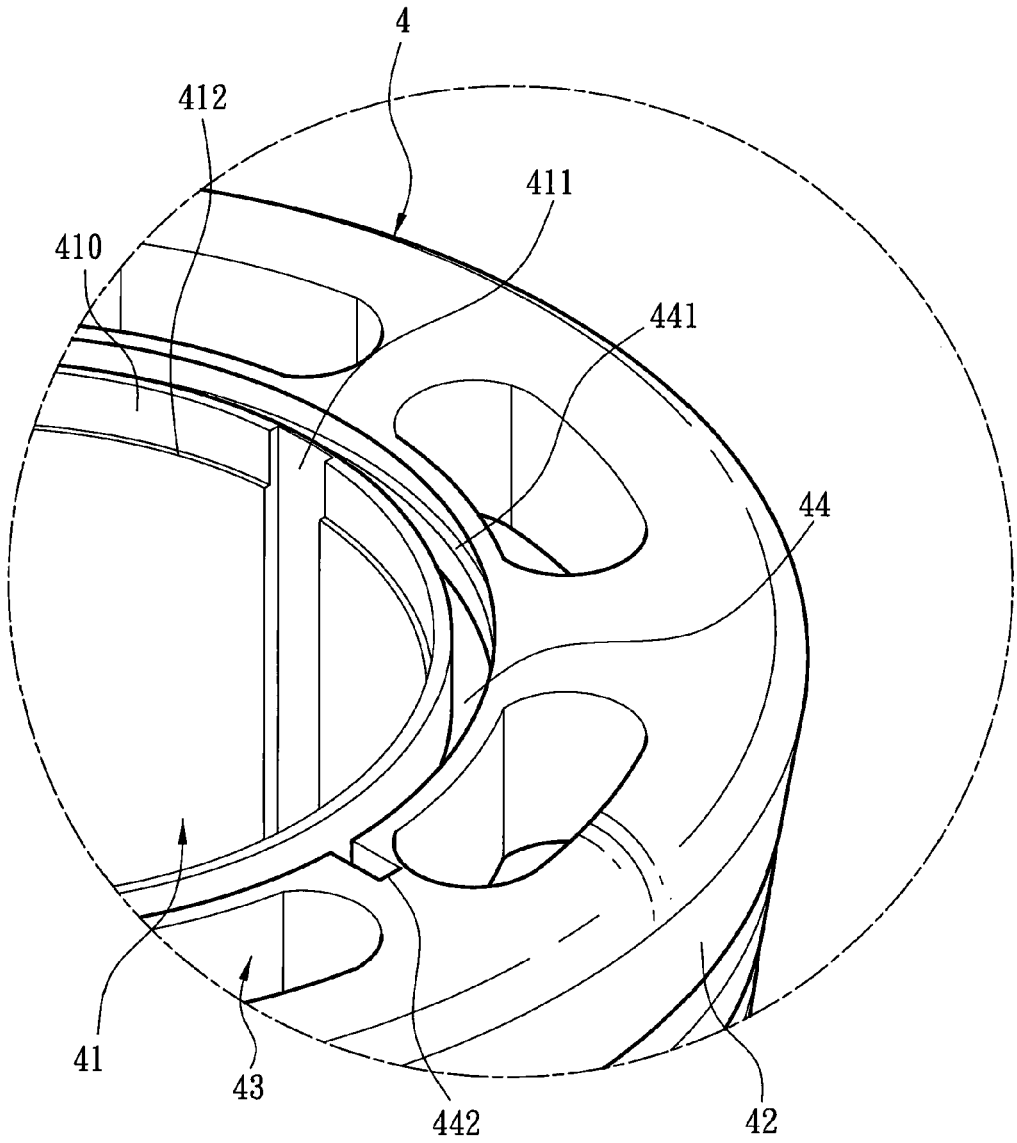
FIG. 1B is a fragmentary enlarged view according to FIG. 1A.
Figure 2:
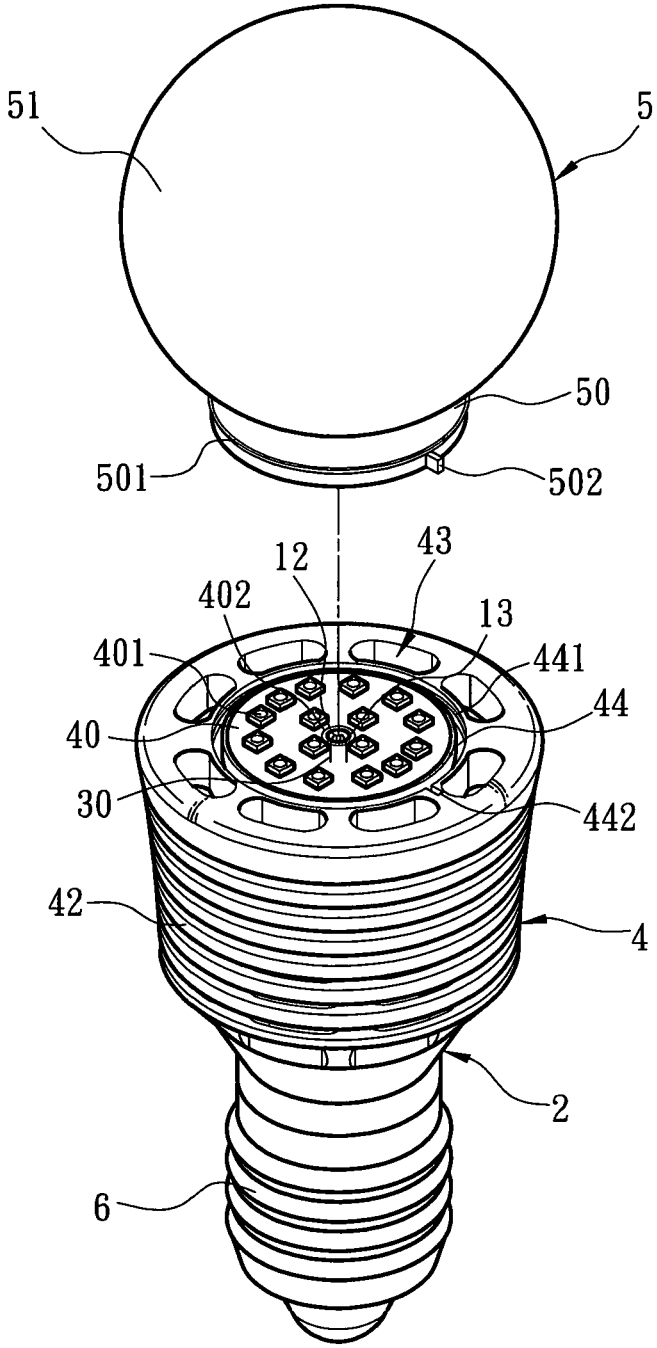
FIG. 2 is a schematic view of the light transparent shell and heat sink in a coupling condition.
Figure 3A:
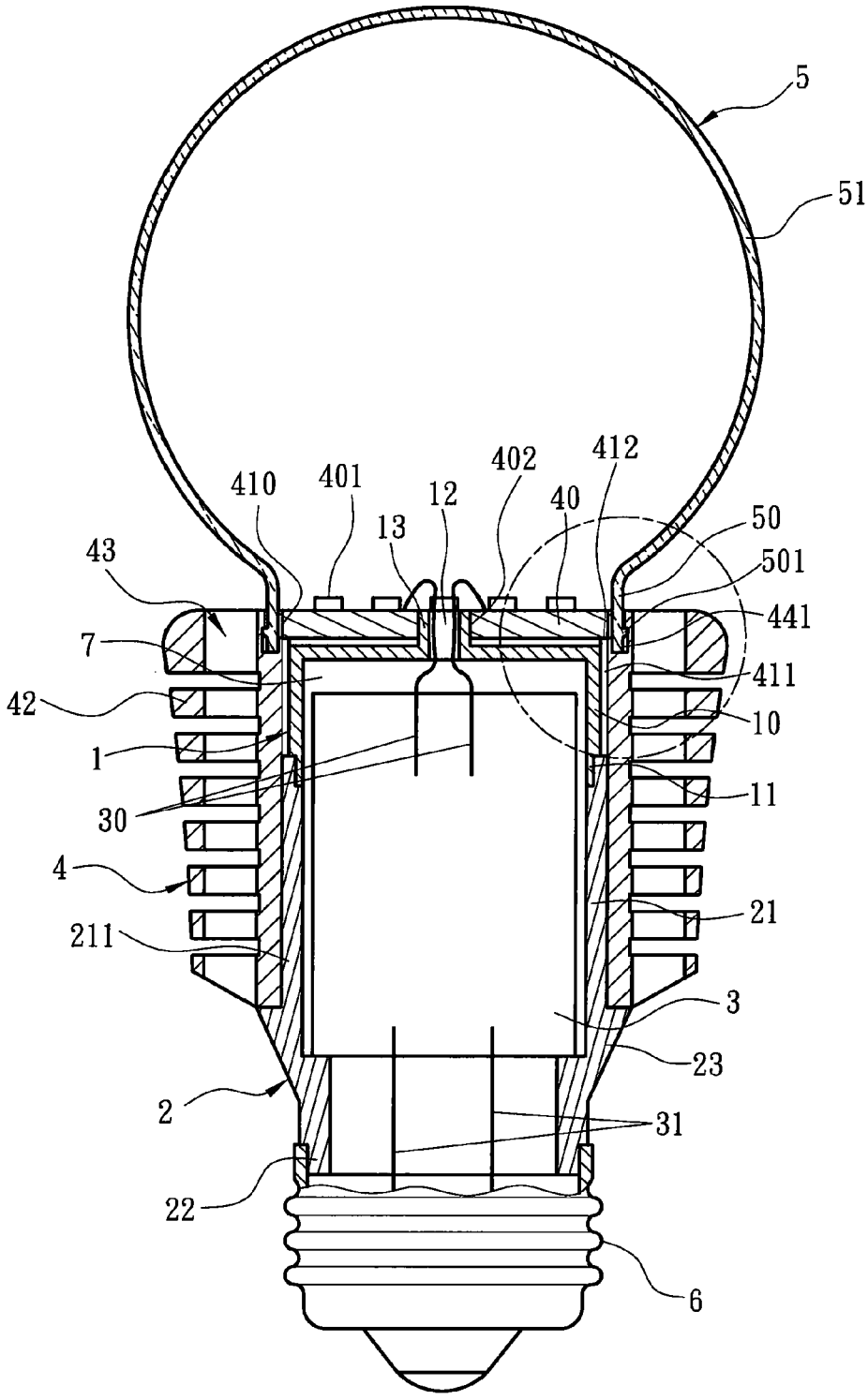
FIG. 3A is a sectional view of the LED light bulb of the invention.
Figure 3B:
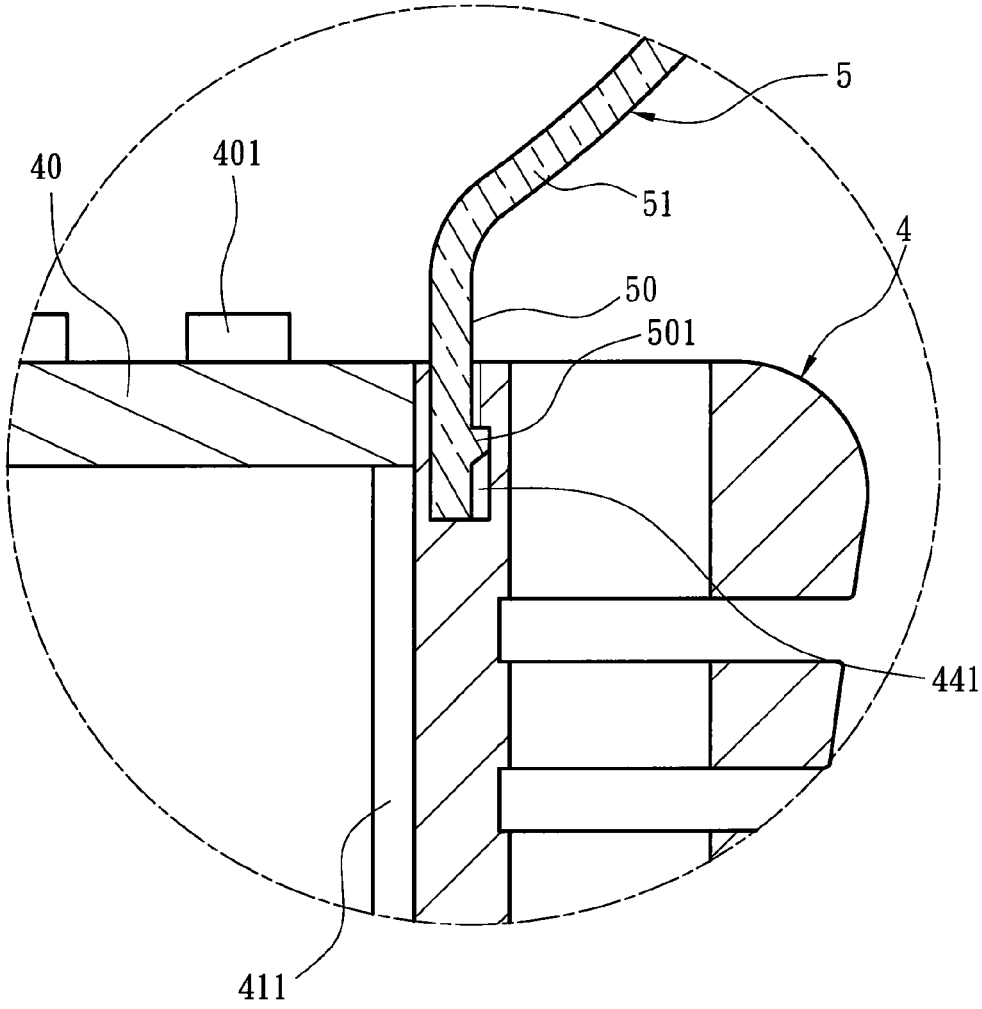
FIG. 3B is a fragmentary enlarged view according to FIG. 3A.

The invention further provides a feature with a novel fastening structure to couple the light transparent shell 5 and heat sink 4 together. The heat sink 4 has a wedged groove 44 outside the coupling wall 410 to hold the light transparent shell 5. The light transparent shell 5 includes a sphere 51 and a neck 50 extended from the sphere 51 to wedge in the wedged groove 44. The sphere 51 has a space inside to hold the light source baseboard 40. The sphere 51 and neck 50 have an inner wall surrounded to hold the light source baseboard 40, and an outer wall on another side opposite to the inner wall. The wedged groove 44 has a wall formed a first holding portion 441. The neck 50 has a longitudinal shell retaining portion 501 formed on the outer wall corresponding and fastening to the first holding portion 441 to restrict the light transparent shell 5 and heat sink 4 from moving vertically against each other. In this embodiment, the longitudinal shell retaining portion 501 is a jutting ring transversely surrounding the neck 50. The first holding portion 441 is a groove corresponding and fastening to the jutting ring. Through fastening of the jutting ring and groove, the light transparent shell 5 can be prevented from moving longitudinally and escaping from the heat sink 4. Moreover, to prevent the light transparent shell 5 from turning in the wedged groove 44, the neck 50 also has at least one transverse shell retaining portion 502 and the wedged groove 44 has at least one second holding portion 442 corresponding and fastening to the transverse shell retaining portion 502. More specifically, the transverse shell retaining portion 502 is a bump while the second holding portion 442 is a notch (as shown in FIGS. 1A and 1B) corresponding to the bump. When the bump is wedged in the notch, the relative turning between the light transparent shell 5 and heat sink 4 is restricted. Thus, by coupling the longitudinal shell retaining portion 501 and transverse shell retaining portion 502 respectively with the first holding portion 441 and second holding portion 442, transverse and longitudinal movements of the light transparent shell 5 can be confined to be securely held in the wedged groove 44. Furthermore, the light transparent shell 5 may have multiple sets of transverse shell retaining portions 502 extended from the outer wall at varying lengths, while the second holding portions 442 are also formed at different depths corresponding to the transverse shell retaining portions 502 so that the transverse shell retaining portions 502 and second holding portions 442 can be fastened to each other to form firmer and secure fastening.

Figure 4:
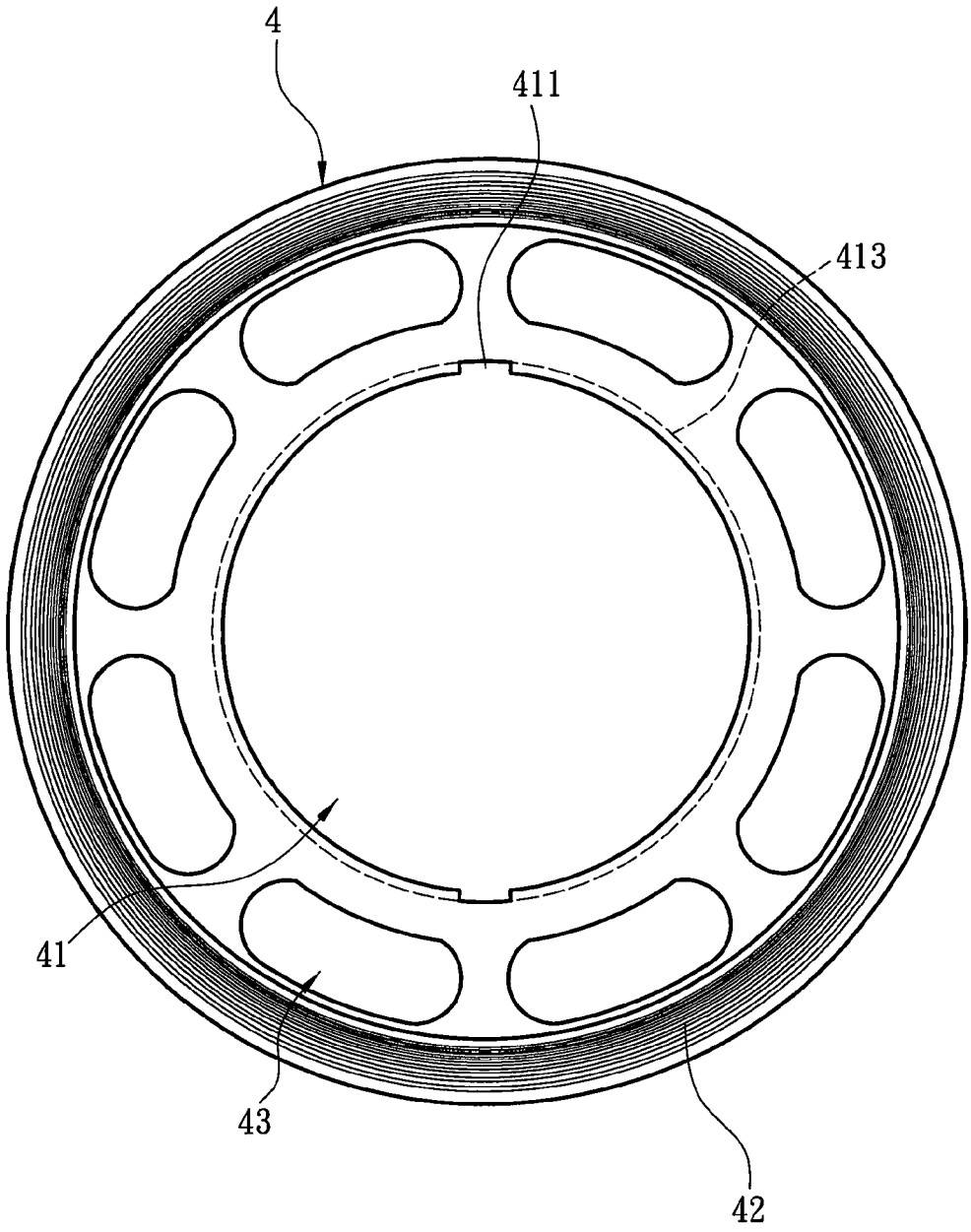
FIG. 4 is a bottom view of the heat sink of the invention.

In order to pass the safety regulation tests, the coupling holder 2 further has an annular insulation wall 21 to form a circuit holding compartment 7 to hold the power conversion board 3, a mask portion 23 and a fastening portion 22. The insulation wall 21 is located between the power conversion board 3 and heat sink 4. The mask portion 23 attaches to a lower side of the heat sink 4 to seal an opening at the lower end of the housing chamber 41. Referring to FIGS. 1A and 4, in order to form a tight coupling between the coupling holder 2 and heat sink 4, the coupling holder 2 has a longitudinal holder retaining portion 211 and the heat sink 4 has a third holding portion 413 corresponding and fastening to the longitudinal holder retaining portion 211 to restrict the coupling holder 2 from moving vertically against the heat sink 4. Similarly, the longitudinal holder retaining portion 211 is a jutting ring surrounding transversely the coupling holder 2, and the third holding portion 413 is a groove fastening to the jutting ring. The coupling holder 2 further has at least one transverse holder retaining portion 212 and the heat sink 4 has at least one fourth holding portion 411 corresponding and fastening to the transverse holder retaining portion 212 to restrict the coupling holder 2 from turning against the heat sink 4. By the same token, the coupling holder 2 may include multiple sets of the transverse holder retaining portions 212 at varying lengths, while the fourth holding portions 411 are formed at different depths corresponding to the transverse holder retaining portions 212 so that the transverse holder retaining portions 212 and fourth holding portions 411 can be fastened to each other to form firmer and secure fastening.

To further improve insulation to protect the power conversion board 3, the LED light bulb may include an isolation member 1 that contains an isolation wall 10 interposed between the power conversion board 3 and heat sink 4, and a wiring outlet 12 located on the isolation wall 10 to connect the power conversion board 3 to the light source baseboard 40 via wires threading therethrough. In order to pass the safety regulation tests, the wiring outlet 12 is surrounded by a protruding portion 13 to prevent piercing from high voltage electric power. As shown in the embodiment in FIG. 1A, the isolation wall 10 has a coupling portion 11 at a distal end fastened to the upper end of the coupling holder 2 so that the isolation wall 10 surrounds and encases the upper side and lateral side of the power conversion board 3 and seals the upper opening of the coupling holder 2. By coupling of the coupling holder 2 and isolation member 1, the power conversion board 3 is isolated in the circuit holding compartment 7.

The light source baseboard 40 further has a wiring bore 402 communicating with the housing chamber 41. The power conversion board 3 has at least one power cord 30 connected thereto and passing through the wiring outlet 12 and wiring bore 402 to connect to the LEDs 401 to form electrical connection between the power conversion board 3 and LEDs 401. The protruding portion 13 may be wedged in the wiring bore 402.

Through the technique previously discussed, the LED light bulb can have the power conversion board 3 installed therein and isolated and protected in the circuit holding compartment 7 through the isolation member 1 and coupling holder 2. Furthermore, the isolation wall 10 and the heat sink 4 are spaced from each other by a gap to protect the power conversion board 3 from being damaged during the high voltage test of the safety regulation tests.

Also referring to FIGS. 1A through 4, the fastening portion 22 of the coupling holder 2 is located outside the housing chamber 41 to couple with a fastening end 61 of the power receiving base 6 to connect to an external power source. Through at least one power cord 31 electrically connecting to the power conversion board 3 and power receiving base 6, the power from the external power source is transmitted to the power conversion board 3. Depending on different light bulb types or application environments, multiple and varying power receiving bases 6 can be selected. FIGS. 1A through 4 illustrate an embodiment adopting a general household light bulb, but this is not the limitation of the power receiving base 6.

Figure 5:
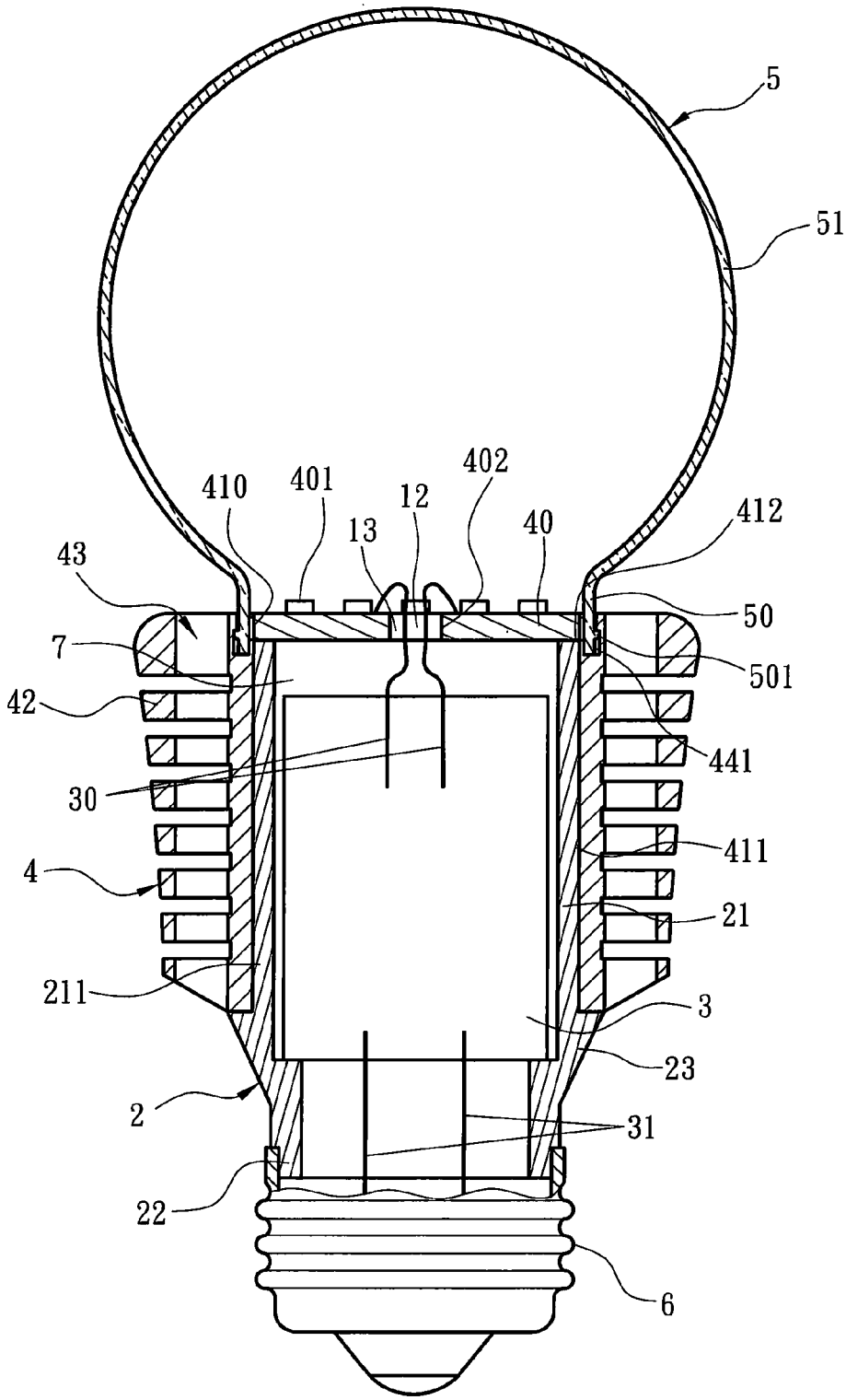
FIG. 5 is a schematic view of another embodiment of the LED light bulb of the invention.

Refer to FIG. 5 for a second embodiment of the LED light bulb. It differs from the first embodiment in that the isolation member 1 can be selected to be installed or not as desired. In this embodiment, there is no isolation member 1 installed. As shown in FIG. 5, the insulation wall 21 is extended upwards to connect to the light source baseboard 40, and the power cord 30 of the power conversion board 3 directly passes through the upper opening of the coupling holder 2 and wiring bore 402 to electrically connect to the light source baseboard 40. The insulation wall 21 fully isolates the power conversion board 3 and heat sink 4, thus provides desired insulation to pass the safety regulation tests.

In the first embodiment shown in FIGS. 1A through 4 and second embodiment shown in FIG. 5, the heat sink 4 has a plurality of radiation fins 42 located on the outer side and stacked over one another. The radiation fins 42 are spaced from each other with gaps between them to facilitate air circulation. The radiation fins 42 also have a plurality of vents 43 formed thereon and arranged to form at least one longitudinal airflow passage running through the heat sink 4 to allow air to pass through. The gaps between the radiation fins 42 and the airflow passage provide air circulation in transverse and longitudinal directions and also increase contact area with the air to achieve better cooling effect.

By means of the techniques previously discussed, the light transparent shell 5 can be firmly fastened to the heat sink 4 through the longitudinal shell retaining portion 501 and transverse shell retaining portion 502 formed on the outer wall thereof. Since the fastening structure is formed on the outer wall of the light transparent shell 5, the light transparent shell 5 can be made of plastics to form a larger curved surface. Take a virtual sphere for an example, the curved surface of the light transparent shell can cover at least 75% of the virtual spherical surface, thus a wider light transparent range can be achieved to increase illumination.

While the invention has been described by means of specific embodiments, numerous modifications and variations could be made thereto by those skilled in the art without departing from the scope and spirit of the invention set forth in the claims.

In summation of the above description, the present invention provides a significant improvement over the conventional techniques and complies with the patent application requirements, and is submitted for review and granting of the commensurate patent rights.

What is claimed is:

1. An LED light bulb equipped with light transparent shell fastening structure, comprising:

a power receiving base;

a power conversion board electrically connected to the power receiving base and at least one light source baseboard;

a heat sink which holds the light source baseboard and includes a housing chamber to hold the power conversion board, the heat sink further including a wedged groove which includes a wall with a first holding portion formed thereon; and a light transparent shell which includes a space to hold the light source baseboard, a sphere and a neck extended from the sphere to wedge in the wedged groove, the sphere and the neck including an inner wall to surround the space and an outer wall on another side opposite to the inner wall, the outer wall of the neck including a longitudinal shell retaining portion corresponding and fastening to the first holding portion to restrict the light transparent shell from moving vertically against the heat sink, wherein the neck further includes at least one transverse shell retaining portion, the wedged groove including at least one second holding portion corresponding and fastening to the transverse shell retaining portion to restrict the light transparent shell from turning against the heat sink.

2. The LED light bulb of claim 1, wherein the longitudinal shell retaining portion and the first holding portion are respectively a jutting surface and an indented surface corresponding to each other.

3. The LED light bulb of claim 2, wherein the longitudinal shell retaining portion surrounds the neck, the first holding portion corresponding to the longitudinal shell retaining portion and surrounding the wedged groove.

4. The LED light bulb of claim 1, wherein the power conversion board is a switch-type power circuit.

5. The LED light bulb of claim 1, wherein the transverse shell retaining portion is a bump extended from the outer wall of the light transparent shell, the second holding portion being a notch located on the wedged groove and corresponding to the bump.

6. The LED light bulb of claim 1, wherein the neck includes a plurality of transverse shell retaining portions extended from the outer wall at varying lengths, the wedged groove including a plurality of second holding portions formed at different depths corresponding to the transverse shell retaining portions.

7. The LED light bulb of claim 1 further including a coupling holder located in the housing chamber, the coupling holder including a fastening portion at one end to fasten to the power receiving base, an insulation wall to form a circuit holding compartment to hold the power conversion board, and a longitudinal holder retaining portion, the heat sink including a third holding portion corresponding and fastening to the longitudinal holder retaining portion to restrict the coupling holder from moving vertically against the heat sink.

8. The LED light bulb of claim 7, wherein the coupling holder further includes at least one transverse holder retaining portion, the heat sink including at least one fourth holding portion corresponding and fastening to the transverse holder retaining portion to restrict the coupling holder from turning against the heat sink.

9. The LED light bulb of claim 7, wherein the coupling holder further includes a mask portion attached to a lower side of the heat sink to seal a lower opening of the housing chamber.

10. The LED light bulb of claim 7 further including an isolation member held in the housing chamber, the isolation member including an isolation wall interposed between the power conversion board and the heat sink and a wiring outlet threaded through by power cords to connect the power conversion board with the light source baseboard, the isolation wall forming compact coupling with the insulation wall of the coupling holder.

11. The LED light bulb of claim 10, wherein the light source baseboard includes a wiring bore communicating with the housing chamber to allow at least one power cord to pass through to form electrical connection with the light source baseboard.

12. The LED light bulb of claim 11, wherein the isolation member includes a protruding portion surrounding the wiring outlet, the protruding portion being wedged in the wiring bore of the light source baseboard.

13. The LED light bulb of claim 1, wherein the light source baseboard is an aluminum baseboard including a plurality of conductive wires.

14. The LED light bulb of claim 1, wherein the heat sink includes a plurality of radiation fins stacked over one another, the radiation fins including a plurality of vents to form at least one airflow passage.

* * * * *